US005542612A

United States Patent [19]

Beisel

[11] Patent Number: 5,542,612

[45] Date of Patent: Aug. 6, 1996

[54] APPARATUS FOR DEHULLING GRASS SEED

[75] Inventor: Victor A. Beisel, Fargo, Okla.

[73] Assignee: Pogue Seed Co., Inc., Kenedy, Tex.

[21] Appl. No.: 245,972

[22] Filed: May 19, 1994

[51] Int. Cl.[6] ..... B02C 9/04; B02C 23/12; B02C 23/40

[52] U.S. Cl. ..... 241/5; 241/7; 241/8; 241/10; 241/11; 241/19; 241/39; 241/69; 241/79.1; 241/80; 241/285.1; 99/527; 406/194; 426/482

[58] Field of Search ..... 99/518, 527; 241/5, 241/7, 8, 10, 11, 12, 13, 19, 24, 39, 69, 77, 79.1, 80, 81, 285.1; 406/194; 426/482, 519

[56] References Cited

U.S. PATENT DOCUMENTS 2,620,841 12/1952 Jacobson ..... 241/8 X
2,759,511 8/1956 Jacobson ..... 241/7 X
4,335,151 6/1992 Caubet ..... 241/7 X
4,505,196 3/1985 Beisel ..... 241/7 X
4,933,072 6/1990 Beisel .

*Primary Examiner*—Timothy V. Eley
*Attorney, Agent, or Firm*—Cox & Smith Incorporated

[57] ABSTRACT

An apparatus for dehulling grass seed utilizing a vibrated housing having an elongated chamber. The interior of the chamber is accessible through openings or ports that provide a plurality of entries and exits for the processing of grass seed. Grass seed is dehulled by a housing mounted pneumatic accelerator that removes the hulls from the seeds. Hulls and seeds are then directed into the interior of the chamber wherein separation of seeds from hulls and hulls containing seeds occurs. Seeds are discharged from the chamber and the hulls containing seeds are returned to the pneumatic accelerator for repeating the dehulling process.

13 Claims, 4 Drawing Sheets

APPARATUS FOR DEHULLING GRASS SEED

FIELD OF THE INVENTION

The present invention relates generally to the separation of grass seeds having different mass and trajectory paths through space, and particularly to dehulling grass seed, then separating the grass seeds from their hulls and more particularly, to the dehulling and separation of hubs from buffelgrass seed.

BACKGROUND OF THE INVENTION

Various types of grasses, as web as grain crops, are grown primarily for seeds, and the value of such seed crops is determined by the purity and germination factor of the harvested seeds. The known methods and apparatus for dehulling seeds, or the like, usually consist of submitting the seeds to some type of mechanical or pneumatic effort to break the hubs and then separate the seeds from the hulls.

One such method to separate seeds from hubs is disclosed in U.S. Pat. No. 4,335,151 to Caubet. Caubet discloses a method of separating seeds from hubs by feeding hulls containing seeds, into a turbulent flow of compressed air in a flow passage of sufficient size to accelerate the hulls containing seeds to a high velocity. The flow of compressed air and hubs containing seeds are than fed into a second passage of much larger cross-sectional area then the first passage. This sudden change of volume greatly expands the air density causing mechanical stresses to be exerted onto the hulls of the seeds thereby cracking the grass seed hubs and allowing the seeds to be separated from the hull.

Mechanical method of dehulling becomes ineffective when the force required to remove the seed from the hub also destroys the seed due to mechanical abrasion and high impact with other seeds and hulls.

U.S. Pat. No. 4,933,072 to Beisel discloses a technique of horizontally projecting a flow mixture of seed, hubs, and hulls containing seeds utilizing pressurized air to propel the flow mixture through a venturi nozzle and coanda curve combination into a classification chamber. That technique proves to be ineffective when the hulls comprise the substantial weight of the hull and seed combination.

U.S. Pat. No. 4,505,196 to Beisel discloses a seed dehuller that has a momentum type separator that is capable of batch dehulling and separating seeds from hulls. That type of separator will periodically expose seeds to high air pressure and then to a period of substantially reduced air pressure to effect the dehulling of the grass seeds. During the period of reduced air pressure the heavier seeds will be separated from the hulls by their greater momentum and directed into a collection bin. That particular type of separator disclosed by Beisel prove ineffective when the grass seed or grains to be dehulled have extremely hard shells such as buffelgrass seed.

Buffelgrass seed is a very hearty and fast growing type of grass. However, buffelgrass seed has a tender seed and a very hard hull that impedes germination of the seed once the seed is planted in the earth. Comparative test results have established that if the hull is removed from buffelgrass seed before planting, an approximate 20-fold increase in germination of the planted seed can be expected.

SUMMARY OF THE INVENTION

The present invention is directed toward the removing of a hull from around a tender seed wherein the seed comprises the substantial portion of the weight of the seed and hull combination. The removal of the seed from its huh is accomplished by friction and grinding action between hulls and hulls containing seeds. This type of dehulling provides less damage to the tender grass seeds, hence greater germination of the seeds. These seeds are then separated from the hulls and any other debris or hull fragments that may occur due to processing by the present invention. The seeds are then ready for shipment to growers of grasses, grains, or the like.

The preferred embodiment of the present invention utilizes a substantially-rectangular, inclined, and continuous vibrated housing having an elongated chamber. This chamber is defined by a bottom wall, a forward sidewall, a rear side wall, two parallel longitudinal side walls, and a top wall detachably enclosing the chamber. The interior of the chamber is accessible through opening or ports in the walls of the chamber, thereby providing means for entry of hulled seed, exit of dehulled seeds, exit of hulls and an exit of hulls containing seeds.

The present invention has disposed within the housing a platform parallel to and spaced from the bottom wall of the housing to provide the means for separating hulls from dehulled seeds and hulls containing seeds. The platform has a length wise adjustable upright barrier adjacent to one end of the platform, whereby seeds and hulls containing seeds only will traverse the platform barrier combination and descend to the bottom of the housing beyond the barrier. Hulls and hull fragments will impact the platform and barrier surface and be urged toward the hull exit by oscillation and/or vibration of the chamber thereby separating grass seed and hulls containing grass seed from hulls. The bottom of the housing has a screen covering the dehulled seed exit. This screen, which vibrates with the housing, is sized to separate seeds from hulls containing seeds. The seeds will pass through the screen openings and exit the housing throughout the dehulled seed exit port. The hulls containing seeds will traverse the screen and exit the housing through the hulls containing seeds exit port.

All hulls containing seeds are processed through a dehulling pneumatic accelerator housing, defined by a first venturi nozzle that has an axial passage with a discharge opening disposed within the upper portion of one end of the housing. The first venturi nozzle has a first inlet coaxially aligned with the axial passage. This inlet has connected thereto a source for supplying a flow of pressurized air.

The first venturi nozzle has a second inlet angularly intersecting the axial passage, proximal to the first inlet. The second inlet has a connecting flow passage to the hulls containing seeds exit port, thereby providing a means for receiving and transporting hulls containing seeds from the housing to the pneumatic accelerator. Within the pneumatic accelerator, the pressurized air flow traverses the second inlet creating a suction flow of hulls and hulls containing seeds. This flow mixture proceeds through the second inlet whereby all hulls and hull containing seeds are traveling at various velocities, causing air turbulence and dehulling by the collision of hulls containing seeds, in the proximity of the first venturi's second inlet.

The pneumatic accelerator is further defined by a second nozzle adjacent and parallel to the discharge end of the first venturi nozzle, the second nozzle defining an axial passage. This axial passage has a discharge opening at one end, parallel and contiguous to the first venturi nozzle's discharge opening, whereby both nozzles have their respective discharge openings communicating with the upper portion of one end of the housing. The other end of the second nozzle is contoured to form an inlet opening, that is aligned with its axial passage that will freely communicate with ambient air. The pneumatic accelerator additionally has an integral lower housing defined by a downwardly directed coanda curving member. This curving member is directed towards the hull exit in the lower portion of the housing whereby a substantial portion of the air stream traversing that curving member has been separated from the seeds, hulls, and hulls containing seeds by the coanda effect of the curving member.

Seeds, hulls, and hulls containing seeds will be directed from the pneumatic accelerator into the upper portion of the housing by their momentums. Seed and hulls containing seeds have a greater momentum then hulls alone because of their relative mass differentials, therefore, most hulls will impact the platform and exit the housing through the hull exit port, and the seeds and hulls containing seeds will traverse the platform to be respectively separated and reprocessed. This process of dehulling, separating hulls from seeds and hulls containing seeds and separating seeds from hulls containing seeds, continues until all seeds are dehulled and separated from their hulls.

Further advantages of the present invention will be readily apparent to those skilled in the art from the following detailed description, taken in conjunction with the annexed sheets of drawings on which is shown, a preferred embodiment of the invention.

DETAILED DESCRIPTION OF THE PREFERRED EMBODIMENT

Figure 1:
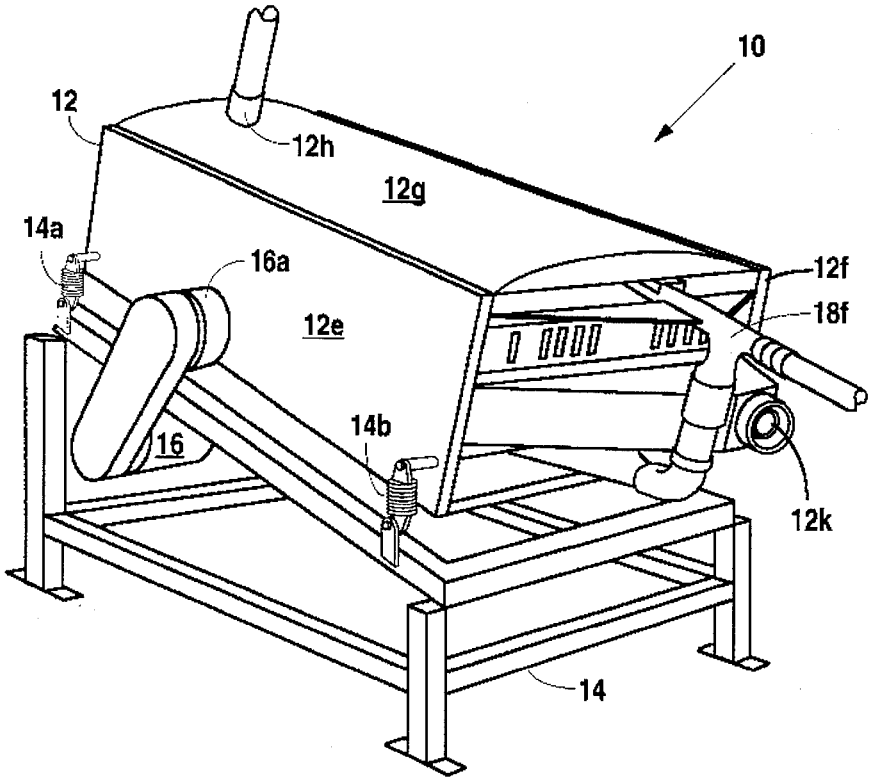
FIG. 1 is a perspective view of a grass seed dehulling machine.
Figure 3:
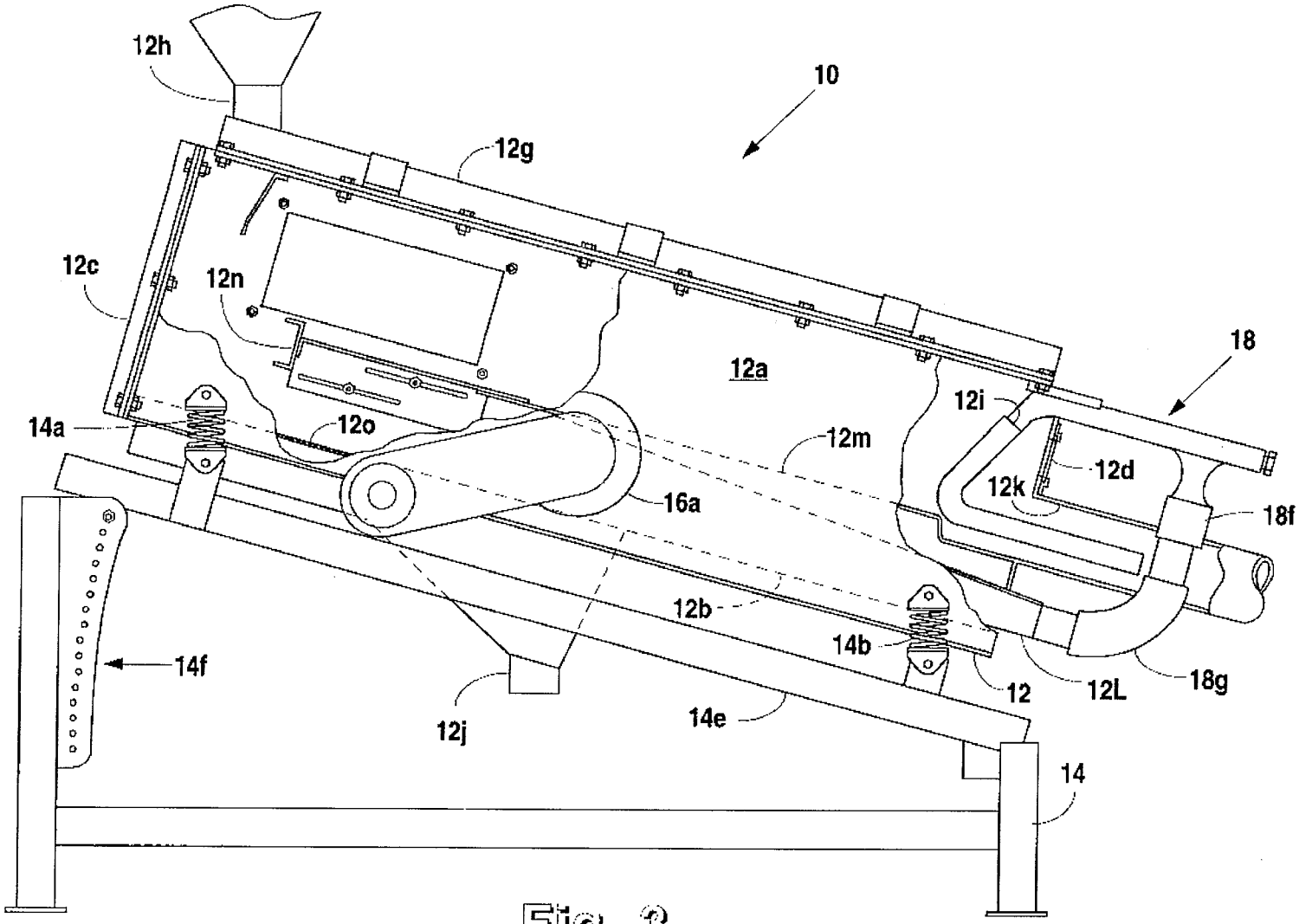
FIG. 3 is a side elevation view of FIG. 1.
Figure 5:
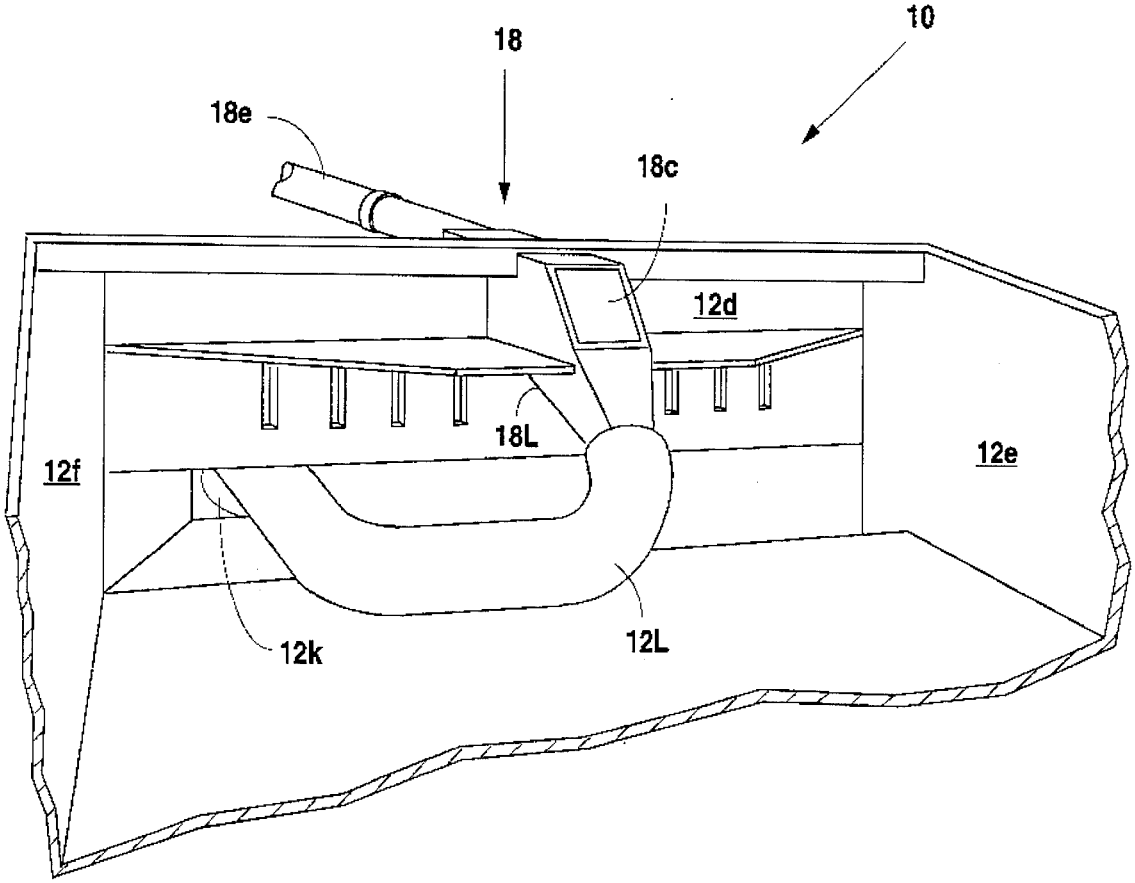
FIG. 5 is a perspective view of a pneumatic accelerator.

FIG. 1 generally shows an apparatus 10 for dehulling and separating grass seed. The apparatus comprises a substantially rectangular housing 12 having an elongated chamber 12*a* (FIG. 3). This chamber is defined by a bottom wall 12*b*, a forward side wall. 12*c*, a rear side wall 12*d*, two parallel longitudinal side walls 12*e* and 12*f*, and a top wall 12*g*, detachably enclosing chamber 12*a*. Housing 12 is mounted to table 14, having a selectably inclined frame 14*e*, by springs 14*a*, 14*b*, 14*c*, and a fourth spring (not shown).

The inclined angle of frame 14*e* is selected by positionally adjusting apparatus 14*f* along its substantially vertical axis. Table 14 and frame 14*e* are sized to support the weight of housing 12 and a full compliment of grass seed. A motor 16 is provided that may, if desired, be mounted adjacent to sidewall 12*e* or 12*f* of housing 12. Motor 16 provides a means to continuously vibrate the housing by the attached cam 16*a* that imparts a vibratory action to housing 12.

Housing 12 has a first entry port 12*h* disposed in top wall 12*g* in proximity to forward wall 12*c* for entry of hulled grass seed. A second entry port 12*i* is disposed in the rear wall 12*d* in proximity to the top wall 12*g* for entry of dehulled seeds, hulls containing seeds, and hulls. Housing 12 also has a first exit port 12*j* disposed in the bottom wall 12*b* for discharging seeds, a second exit port 12*k* for the exit of hulls, and a third exit port 12 for hulls containing seeds. Exit ports 12*k* and 12*l* are disposed in the lower portion of the rear wall 12*d* as illustrated in FIG. 4.

The interior of housing 12*c* has a means for separating hulls from dehulled seeds and hulls containing seeds. This means is defined by a platform 12*m* having one end lengthwise adjustable by an extension member 12*n*, whereby only seeds and hulls containing seeds due to their greater momentum will traverse members 12*m* and 12*n* and descend to the bottom of housing 12.

The bottom of housing 12 has a screen 12*o* covering exit 12*j*. Screen 12*o* has openings sized to separate seeds from hulls containing seeds whereby hulls containing seeds traverse screen 12*o* and exit housing 12 through exit port 12*l* and dehulled seeds pass through the openings of screen 12*o* and are discharged from housing 12 through seed exit port 12*j*.

Figure 4:
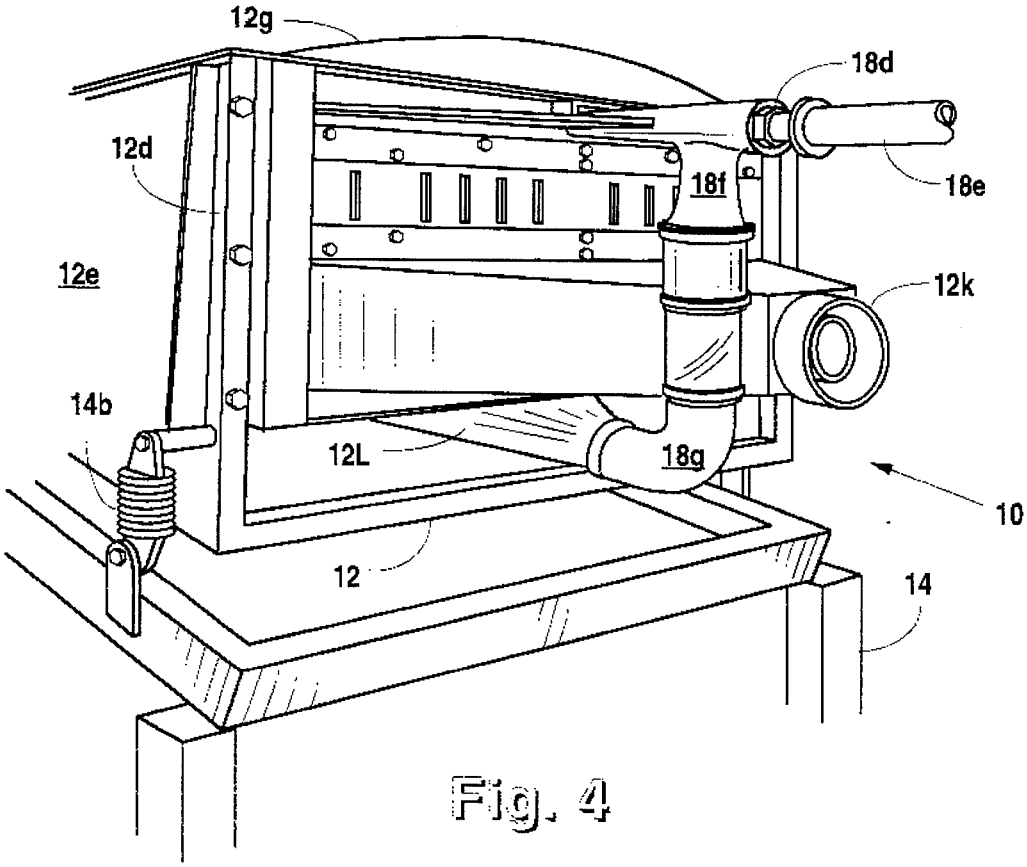
FIG. 4 is a perspective end view of FIG. 2.
Figure 2:
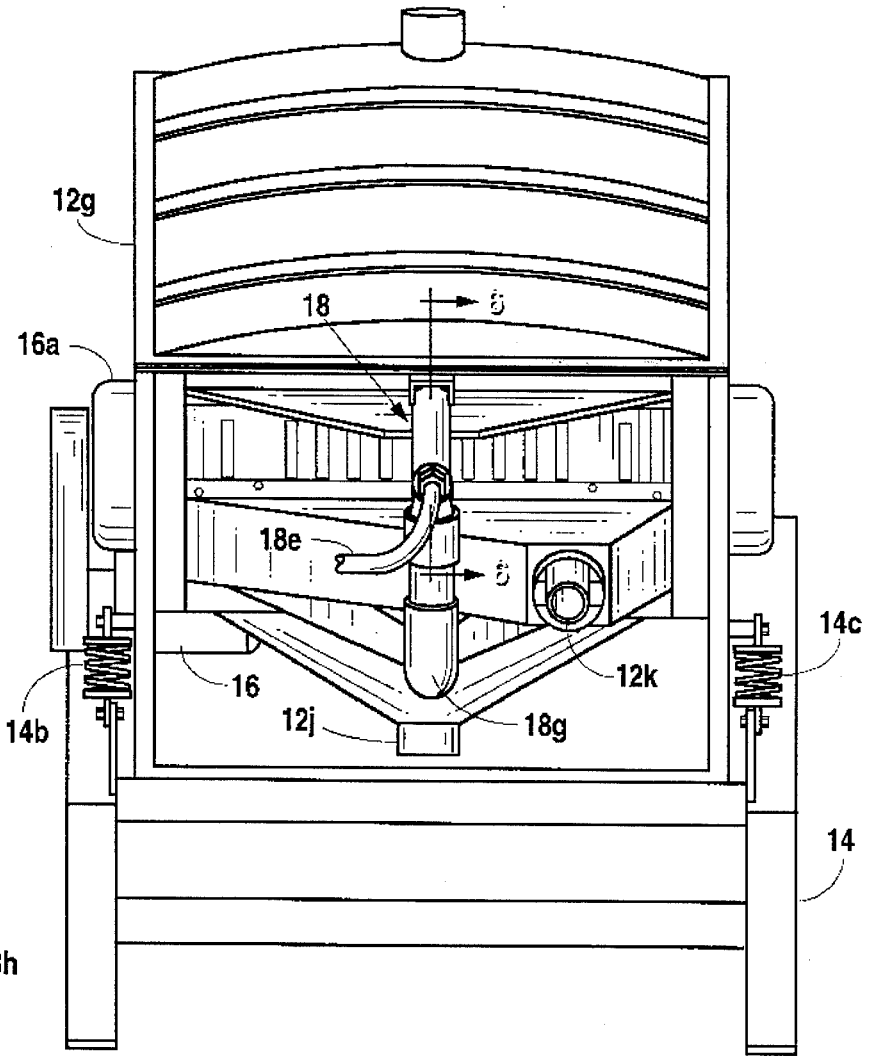
FIG. 2 is an end view of FIG. 1.

A pneumatic accelerator 18 mounted on the upper portion of rear wall 12*d* of apparatus 10, is generally shown on FIG. 4. Accelerator 18 provides the means for removing seeds from their hulls. This means is defined by a first venturi nozzle 18*a* (FIG. 6) having an axial passage 18*b*. Axial passage 18*b* has a discharge opening 18*c* that is disposed within the upper portion of rear wall 12*d*. The first venturi nozzle has an axial flow barrier 18*n* traversing axial passage 18*b* proximal to the first inlet 18*d*. Barrier 18*n* has a plurality of axially parallel perforations 18*p* for producing a laminar flow of air in axial passage 18*b*. Accelerator 18 also has a conventional compressor (not shown) for supplying pressurized air flow to first inlet 18*d*.

A second inlet 18*f* angularly intersects the axial passage 18*b* proximal to first inlet 18*d*. Inlet 18*f* has joined thereto a tube 18*g* providing a conduit for hulls containing seeds from exit 12*l* to second inlet 18*f*, whereby the pressurized air flow 18*e* traversing the second inlet 18*f* creates a suction flow mixture of hulls and hulls containing seeds that will traverse second inlet 18*f*. Those mixture components are all traveling at various velocities, causing air turbulence and dehulling by the collisions of hulls containing seeds with other hulls in the proximity to first venturi 18*a* and spaced from second inlet 18*f*.

Figure 7:
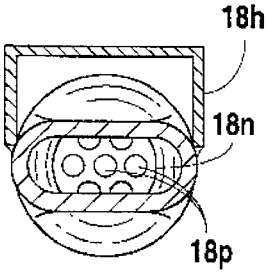
FIG. 7 is a cross-sectional view of a FIG. 5.
Figure 6:
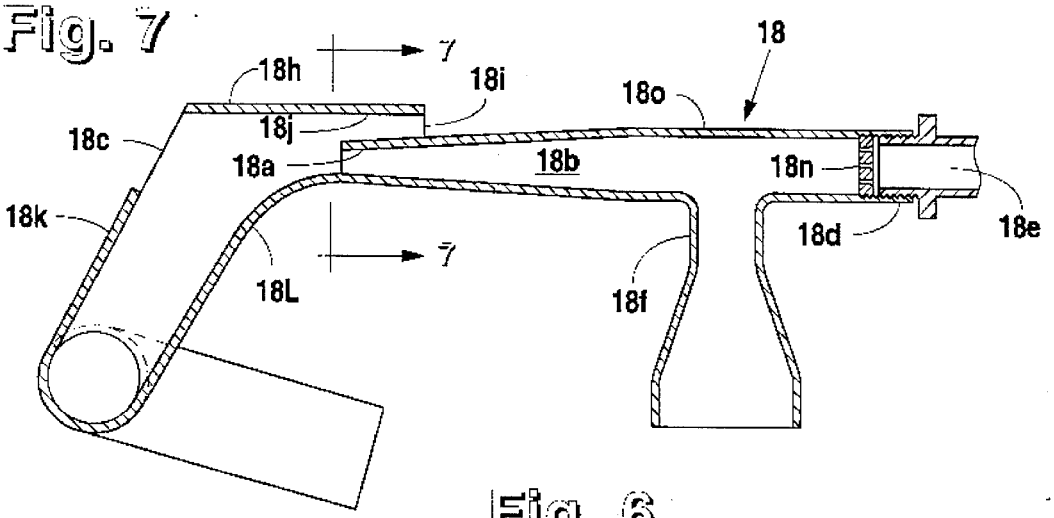
FIG. 6 is a sectional view of FIG. 5 at 6—6.

Referring to FIG. 6, accelerator 18's first nozzle 18*a* is defined by a first cylindrical tube 18*o* having one end comprising a first air flow inlet 18*d*. The other end of tube converges to a substantially rectangular shape as shown on FIG. 7. A second substantially rectangular tube 18*h* is disposed adjacent to the first tube 18*o* and has one open end 18*i*, communicating freely with ambient air. The other end of second tube 18*h* is expanded, thereby defining a second nozzle 18*j* disposed parallel to and integral with the first venturi nozzle 18*a*. Accelerator 18 has a substantially rectangular tubular like conduit or housing 18*k* having one end integral with rectangular tube 18*h* and first tube 18*o* as shown in FIG. 6. Housing 18*k* is in air flow communication with first venturi nozzle 18*a*. Housing 18*k* traverses the second entry port 12*i*, wherein the sidewalls of housing 18*k* contact and curve downwardly (FIG. 6), defining a downwardly coanda curving member 18L. Curving member 18L converges to a cylindrical shape that is sized to enter the second exit port 12*k* and terminates therein as shown at 12*p* whereby the air flow traversing curving member 18L exits housing 12 along exit port 12*k*, providing a suction effect within the closed housing. That suction effect will aid in the discharge of hulls from housing 12. Housing 18*k* has a port 18*c* axially aligned with the first nozzle 18*a* and second nozzle 18*j* for receiving and directing the air flow containing seeds, hulls, and hulls containing seeds into housing 12.

The best mode of operation for the dehulling and separation of grass seeds by apparatus 10 will now be described. Hulled grass seeds are provided to entry port 12*h* of housing 12 while housing 12 is vibrated by motor 16 and cam 16*a*. The hulled grass seeds free, fall to the bottom of chamber 12*a*, and traverse a screen 12*o* that is covering seed exit port 12*j*. The hulled grass seeds proceed along the bottom of chamber 12*a* to exit port 12. Exit port 12 is connected to the second inlet 18*f* of accelerator 18 by tube 18*g*. Pressurized air flow traverses inlet 18*f* causes a suction flow of hulled seeds into the inlet 18*f*. That flow mixture containing air and hulled seeds enter into axial passage 18*b*, whereby separation of the hulls from the seeds occurs due to collision of the hulled seeds with other hulled seeds and the grinding action of empty hulls on hulled seeds.

The flow mixture now contains air, hulls containing seeds, hulls, and dehulled seeds all traversing axial passage 18*b* and towards venturi nozzle 18*d*. The air pressure within nozzle 18*a* begins to decrease and the velocity of the flow mixture begins to increase. The flow mixture exits nozzle 18*a* into tube 18*h* where a substantial amount of air flow will follow coanda curve 18*l* and exit housing 12 through the second exit port 12*k*. The remainder of the flow mixture is directed into the momentum separation chamber 12*a* through port 18*c*. Hulls, seeds, and hulls containing seeds will naturally separate due to differences in mass and trajectory. Empty hulls, having the least mass of the mixture, impact platform 12*m* and are gravity fed to exit port 12*k* whereby the hulls exit chamber 12*a*.

The mass of hulls containing seeds and the mass of seeds are very nearly the same, therefore, both will pass over platform 12*m* and free fall toward the bottom of chamber 12*a*. The resulting location on the bottom of chamber 12*a* for the hulls containing seeds and seeds is approximately the same as the hulled seeds from port 12*h*.

Platform 12*m* has a length wise adjustable extension 12*n* that provides a control mechanism to select the quantity of hulls that will be mixed with seeds and hulls containing seed that traverse platform 12*m*.

The actual position of adjusting member 12*n* is dependent on various atmospheric conditions, such as humidity and barometric pressure. Also, the moisture content of the grass seed will effect the relative position of adjusting member 12*n*. The final position of adjusting member 12*n* is determined by empirical means, e.g., given the above variables adjusting member 12*n* is adjusted to provide the most seeds exiting port 12*j*.

Seeds and hulls containing seeds that have traversed platform 12*m* and adjusting member 12*n* are gravity fed to an area ahead of screen 12*o* covering seed exit 12*j*. The vibration of housing 12 by motor and cam 16*a* will move seeds and hulls containing seeds across screen 12*o*. Screen 12*o* is sized to permit the seeds to pass through the screen openings and descend to exit port 12*j*. Hulls containing seeds proceed along the bottom of chamber 12*a* to exit port 12L. Port 12L is connected to accelerator 18 by tube 18*g*, whereby the process of dehulling continues until all hulls are removed from the grass seeds.

The invention now being fully described, it will be apparent to one of ordinary skill in the art that many changes and modifications can be made thereto without departing from the spirit or scope of the invention as set forth herein.

I claim:

1. The method of dehulling seeds comprising the steps of:

providing a momentum separation chamber;

producing a laminar flow of pressurized air into the inlet of a venturi first nozzle mounted in a chamber wall and having a substantially horizontal axis;

injecting a mixture of empty hulls, seeds, and hulls containing seeds transversely into said laminar air flow, thereby creating a turbulent air flow and subjecting hulls containing seeds to frictional engagement with other hulls to remove hulls from their respective seeds; and directing a portion of the air flow discharged from said first venturi nozzle into a second nozzle having a substantially horizontal outlet and a downwardly directed coanda surface communicating with a pipe traversing the chamber wall, thereby diverting a substantial portion of the air flow discharged from the outlet of said venturi first nozzle and permitting the horizontal discharge of the empty hulls, seeds and remaining hulls with seed into said momentum separation chamber.

2. The method of dehulling seeds as recited in claim 1, further comprising the step of adjusting a lengthwise extendable member within said separation chamber for separating hulls from hulls containing seeds.

3. An apparatus for dehulling and separating grass seeds from hulls, comprising:

a substantially rectangular housing defining an elongated chamber;

means disposed on said housing for entry of hulled grass seed;

means disposed on said housing for an exit of dehulled seeds;

means disposed on said housing for an exit of hulls;

means disposed within said housing for separating dehulled seeds, from hulls and hulls containing seeds;

a first venturi nozzle having an axial passage, said axial passage having a discharge opening disposed within the upper portion of one end of said housing;

said first venturi nozzle having a first inlet coaxially aligned with said axial passage;

said first venturi nozzle having a second inlet intersecting said axial passage proximal to said first inlet;

means for supplying pressurized air flow to said first inlet; and means for supplying hulls containing seeds from said separating means in said chamber to said second inlet;

whereby said pressurized air flow traverses said second inlet creating a suction flow of hulls and hulls containing seeds in said second inlet all traveling at various velocities, causing air turbulence and dehulling by collision of hulls containing seed with other hulls in proximity to said first venture nozzle's second inlet.

4. An apparatus for dehulling and separating grass seed as recited in claim 3, further comprising;

a second nozzle adjacent and parallel to said discharge opening of said first venturi nozzle, said second nozzle defining a second axial passage;

said second axial passage having a discharge opening parallel and contiguous to said first venturi nozzle's discharge opening, whereby both said nozzles have their respective discharge openings communicating with said upper portion of one end of said housing;

said second nozzle having an inlet opening aligned with said second axial passage and freely communicating with ambient air; and means for discharging hulls from said housing defined by a downwardly directed conduit curving towards said hull exit in the lower portion of said chamber whereby a portion of said air flow will traverse said curving member and be discharged from said housing through said hull exit.

5. An apparatus for dehulling and separating grass seed as recited in claim 4, wherein said means for discharging hulls comprises a conduit having a substantially rectangular cross-section first end operably connected to the discharge ends of said first and second nozzles;

said conduit having a downwardly curving bottom wall, upstanding generally vertical sidewalls on opposed edges of said bottom wall, and a top wall to define a coanda portion;

said conduit converging to a second end of cylindrical shape sized to enter said hull exit in said housing, whereby said air flow portion is discharged from said housing; and said top wall having an opening therein aligned with said discharge opening of said first nozzle.

6. An apparatus for dehulling and separating grass seed as recited in claim 3, further comprising a barrier in said first inlet opening, said barrier having a plurality of axially parallel perforations for producing a laminar flow of air into said first axial passage.

7. An apparatus for dehulling and separating grass seed as recited in claim 3, wherein said chamber comprises a bottom wall, a forward side wall, a rear side wall, two parallel longitudinal side walls and a top wall detachably enclosing said chamber;

means for inclining said housing comprise a selectively inclined table sized to support the weight of said housing and the grass seed;

means for vibrating said housing comprise a plurality of springs suspending said housing from said table; and a motor driven cam attached to said housing imparting vibratory action to said housing whereby said motor driven cam vibrates said housing.

8. An apparatus for dehulling and separating grass seed as recited in claim 7, wherein said means for entry of hulled grass seed comprise a entry port disposed in said top wall in proximity to said forward wall.

9. An apparatus for dehulling and separating grass seed as recited in claim 7, wherein said means disposed within said housing for separating hulls from dehulled seeds and hulls containing seeds comprise an elongated platform parallel to and spaced from said bottom wall of said housing, said platform being adjustable in length, whereby only seeds and hulls containing seeds will traverse said platform and descend to the bottom of said housing.

10. An apparatus for dehulling and separating grass seed as recited in claim 7, further comprising a screen covering said seed exit;

said screen having openings sized to separate seeds from hulls containing seeds whereby the hulls containing seeds traverse said screen to be discharged through said means for supplying hulls containing seeds and the seeds pass through said screen's openings and discharge from said housing through said dehulled seed exit.

11. An apparatus for dehulling and separating grass seeds from hulls comprising in combination;

a substantially rectangular housing defining an elongated chamber having a bottom wall, top wall, and sidewalls interconnecting said bottom and top walls;

resilient means for supporting said housing with said bottom wall in a vertically inclined position;

a screen mounted in said chamber in generally parallel overlying relation to said bottom wall and sized to gravitionally separate dehulled seeds from hulls;

inlet means in said housing top wall for hulled seeds;

a first outlet means in the lower portion of said bottom wall and below said screen for receiving dehulled seeds;

a second outlet means in the lower portion of said housing adjacent to the top surface of said screen for collecting empty hulls and hulls containing seeds discharged from the lower end of said screen; and pneumatic accelerator means, disposed within said housing, operatively connected to said second outlet means, for receiving hulls and hulls containing seeds and frictionally engaging said hulls to remove seeds from hulls containing seeds;

said pneumatic accelerator having a first discharge nozzle directing air flow seeds, and hulls containing seeds toward said upper end of said chamber;

a third outlet in the lowermost side wall of said housing; and said pneumatic accelerator having a second discharge nozzle adjacent to said first discharge nozzle and defining a downwardly directed coanda curve communicating with said third outlet in the lowermost sidewall of said housing to produce suction to move empty hulls into said third outlet.

12. The apparatus of claim 11, further comprising barrier means adjustably positioned along the length of said chamber to prevent empty hulls discharged from said first nozzle from entering the upper portions of said chamber.

13. The apparatus of claim 12, further comprising means for vertically vibrating said housing and said screen.

* * * * *